US008079411B2

(12) United States Patent
Cerra et al.

(10) Patent No.: US 8,079,411 B2
(45) Date of Patent: Dec. 20, 2011

(54) HEAT ABSORBING DEVICE USABLE TO COOL HOT BEVERAGES

(76) Inventors: Donna Lyn Cerra, Claverack, NY (US); Faisal Issa Yaquob El-Fanek, Abu Dhabi (AE)

( * ) Notice: Subject to any disclaimer, the term of this patent is extended or adjusted under 35 U.S.C. 154(b) by 901 days.

(21) Appl. No.: 12/044,237

(22) Filed: Mar. 7, 2008

(65) Prior Publication Data

US 2008/0216988 A1 Sep. 11, 2008

Related U.S. Application Data

(60) Provisional application No. 60/894,203, filed on Mar. 10, 2007.

(51) Int. Cl.
*F25D 3/00* (2006.01)

(52) U.S. Cl. ..... 165/185; 62/293

(58) Field of Classification Search ..... 165/185; 62/293, 437, 457.3, 457.9; 220/574.2, 592, 220/17

See application file for complete search history.

(56) References Cited

U.S. PATENT DOCUMENTS

| | | | | |
|---|---|---|---|---|
| 544,219 | A | | 8/1895 | Godet |
| 1,030,325 | A | | 6/1912 | Peoples et al. |
| 1,199,593 | A | | 9/1916 | Muller |
| 1,218,827 | A | | 3/1917 | Baer |
| 1,471,449 | A | * | 10/1923 | Cahill ..... 62/457.1 |
| 1,572,242 | A | * | 2/1926 | McLaughlin ..... 62/392 |
| 1,721,311 | A | | 7/1929 | Muenchen |
| 2,075,137 | A | | 3/1937 | Rosen |
| 2,160,165 | A | | 5/1939 | Patterson |
| 2,688,467 | A | | 9/1954 | Leatzow |
| 2,876,634 | A | | 3/1959 | Zimmerman et al. |
| 3,463,140 | A | | 8/1969 | Rollor |
| 4,531,383 | A | * | 7/1985 | Zimmermann ..... 62/457.4 |
| 4,782,670 | A | | 11/1988 | Long et al. |
| 4,816,048 | A | | 3/1989 | Kimmelshue |
| 5,076,463 | A | | 12/1991 | McGraw |
| 5,235,823 | A | | 8/1993 | Coker |
| 5,609,039 | A | | 3/1997 | Green et al. |
| 5,979,164 | A | * | 11/1999 | Scudder et al. ..... 62/4 |
| 6,474,096 | B1 | | 11/2002 | De la Guardia |
| 6,634,417 | B1 | | 10/2003 | Kolowich |
| 6,758,058 | B1 | | 7/2004 | Citrynell et al. |
| 2003/0196448 | A1 | * | 10/2003 | Roth et al. ..... 62/457.3 |

* cited by examiner

*Primary Examiner* — Teresa Walberg
(74) *Attorney, Agent, or Firm* — Berenato & White, LLC

(57) ABSTRACT

A heat absorbing device usable to cool hot beverages includes a support rim for supporting the device on a brim of a container and a heat absorbing element extending away from the support rim in a first direction. The heat absorbing element includes a thermally conductive material for absorbing heat from a liquid in the container. A handle extends away from the support rim in a second direction opposite to the first direction. The handle is usable for positioning the heat absorbing element in the container and for removing the heat absorbing element from the container.

21 Claims, 8 Drawing Sheets

HEAT ABSORBING DEVICE USABLE TO COOL HOT BEVERAGES

CROSS REFERENCE(S) TO RELATED APPLICATIONS AND CLAIMS TO PRIORITY

The present application claims priority from U.S. Provisional Patent Application No. 60/894,203 filed Mar. 10, 2007, the contents of which are incorporated herein by reference and to which priority is claimed

FIELD OF THE INVENTION

The present invention relates to a heat absorbing device usable to cool hot beverages, a beverage container assembly, and a method of using the heat absorbing device. The present invention also relates to a method of manufacturing the heat absorbing device.

BACKGROUND OF THE INVENTION

Heat absorption devices, also known as heat dissipating devices, are generally known. These devices are typically inserted into a container to cool a beverage to the point where it can be comfortably consumed. However, conventional heat absorption devices suffer from a number of deficiencies.

Some heat absorbing devices include refrigerated components or other large or voluminous configurations for cooling hot beverages. These heat absorbing devices, because of their size, have a tendency to displace the beverage causing spilling and possible burning of the consumer.

Other conventional devices are simply too complex or are inefficient at cooling hot beverages. Indeed, some designs utilize toxic coolant, freezable material, or many parts requiring assembly. Thus, these designs are expensive to manufacture and/or do not provide sufficient benefit to consumers to warrant using and/or purchasing. Moreover, the designs utilizing toxic coolant pose the risk of accidental ingestion by consumers. As a result, these designs are not commercially viable.

Some prior heat absorbing devices also include small grooves that are hard to clean. As a result, bacteria or other microorganisms accumulate in these grooves making the repeated use of these devices not hygienic.

Accordingly, there is a need for an improved heat absorbing device having a design that is simple and easy to clean for efficiently lowering the temperature of a hot beverage without displacing the volume of the beverage.

SUMMARY OF THE INVENTION

The present invention provides a heat absorbing device usable to cool hot beverages. The device includes a support rim for supporting the device on a brim of a container and a heat absorbing element extending away from the support rim in a first direction. The heat absorbing element includes a thermally conductive material for absorbing heat from the beverage in the container. A handle extends away from the support rim in a second direction opposite to the first direction. The handle is usable for positioning the heat absorbing element in the container and for removing the heat absorbing element from the container.

The present invention also provides a beverage container assembly. The container assembly includes a container including a bottom wall and a side wall extending upwardly from the bottom wall. The bottom and side walls define an inner space of the container, and a top edge of the side wall forms a brim of the container. A beverage is disposed in the inner space of the container. A heat absorbing element is disposed in the inner space of the container for absorbing heat from the beverage contained therein. The heat absorbing element includes at least one elongated fin extending along a longitudinal center axis of the inner space.

The present invention also provides a method of cooling a hot beverage in a container using a heat absorbing device. The heat absorbing device includes a support rim, a heat absorbing element having a plurality of elongated fins extending away from the support rim in a first direction, and a handle extending away from the support rim in a second direction opposite to the first direction. The method includes grabbing the handle of the heat absorbing device, and inserting the plurality of elongated fins of the heat absorbing device into the container such that the support rim is supported on a brim of the container and the fins extend downwardly from the support rim into the beverage.

The present invention also provides a method of manufacturing the heat absorbing device described above.

Other aspects and embodiments of the present invention will become apparent from the following description of the preferred embodiments.

DETAILED DESCRIPTION OF THE INVENTION

Figure 1:
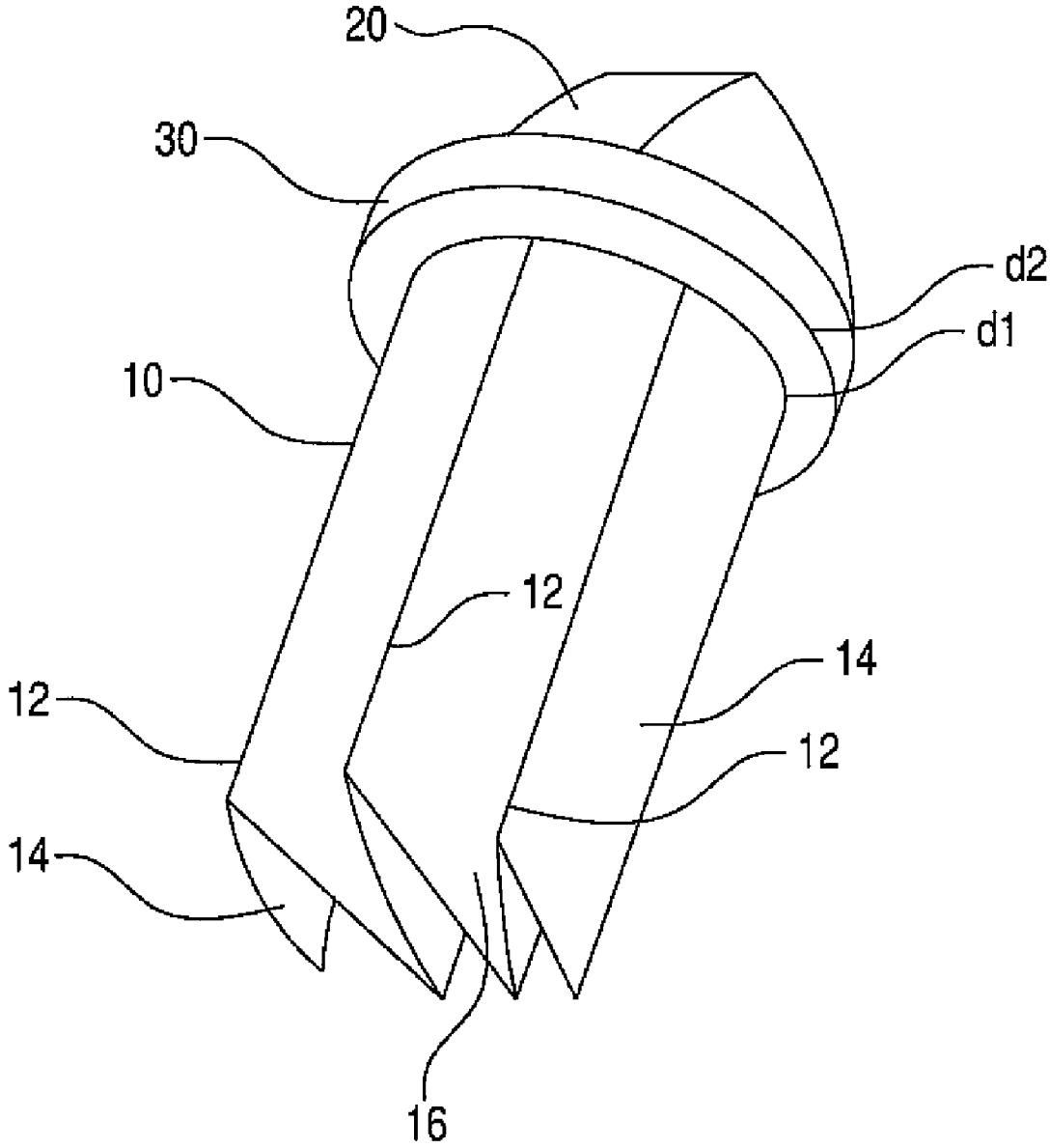
FIG. 1 is a perspective bottom view of a heat absorbing device according to an embodiment of the present invention.

Reference will now be made in detail to the embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification.

Figure 2:
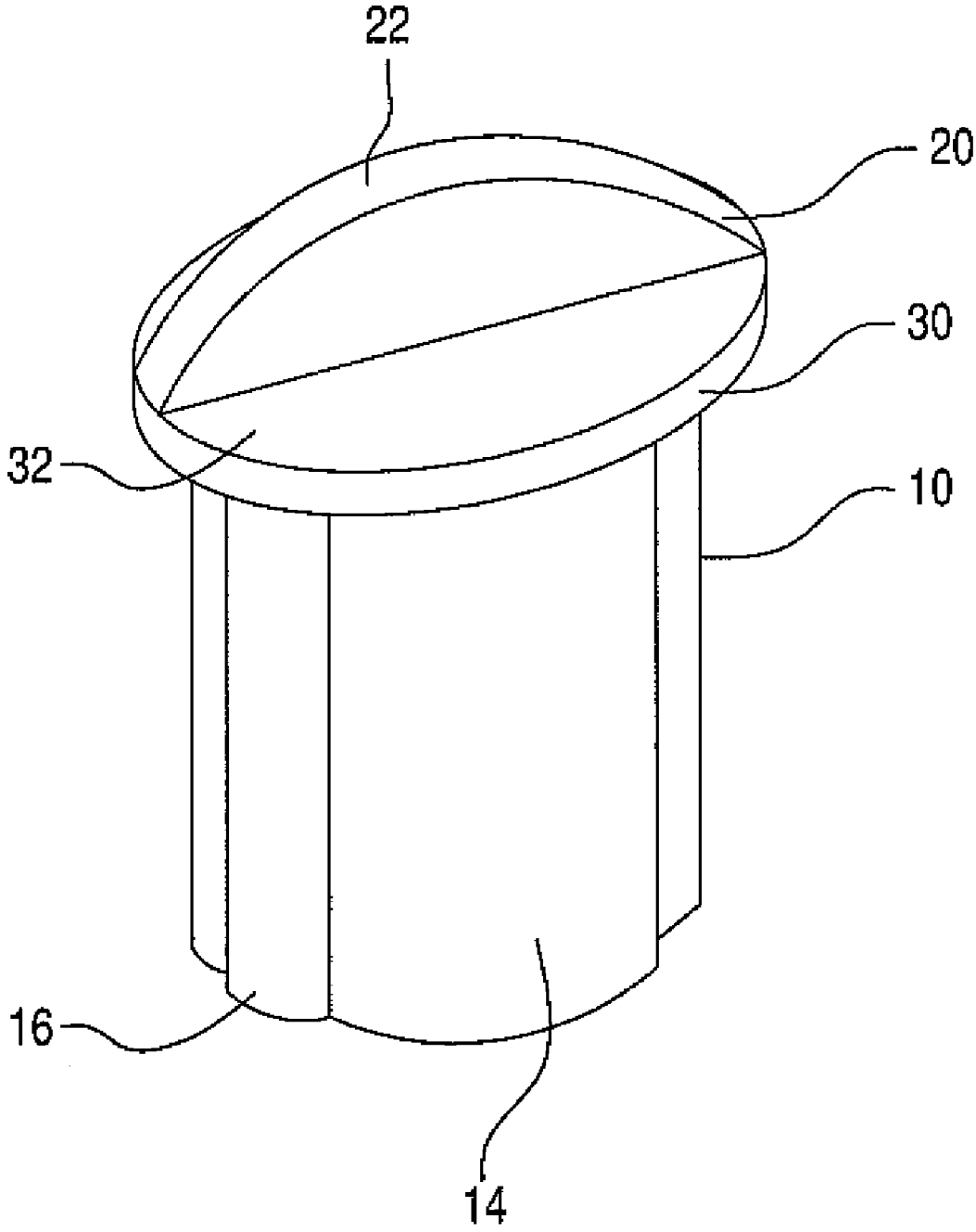
FIG. 2 is a perspective top view of the heat absorbing device of FIG. 1.
Figure 3:
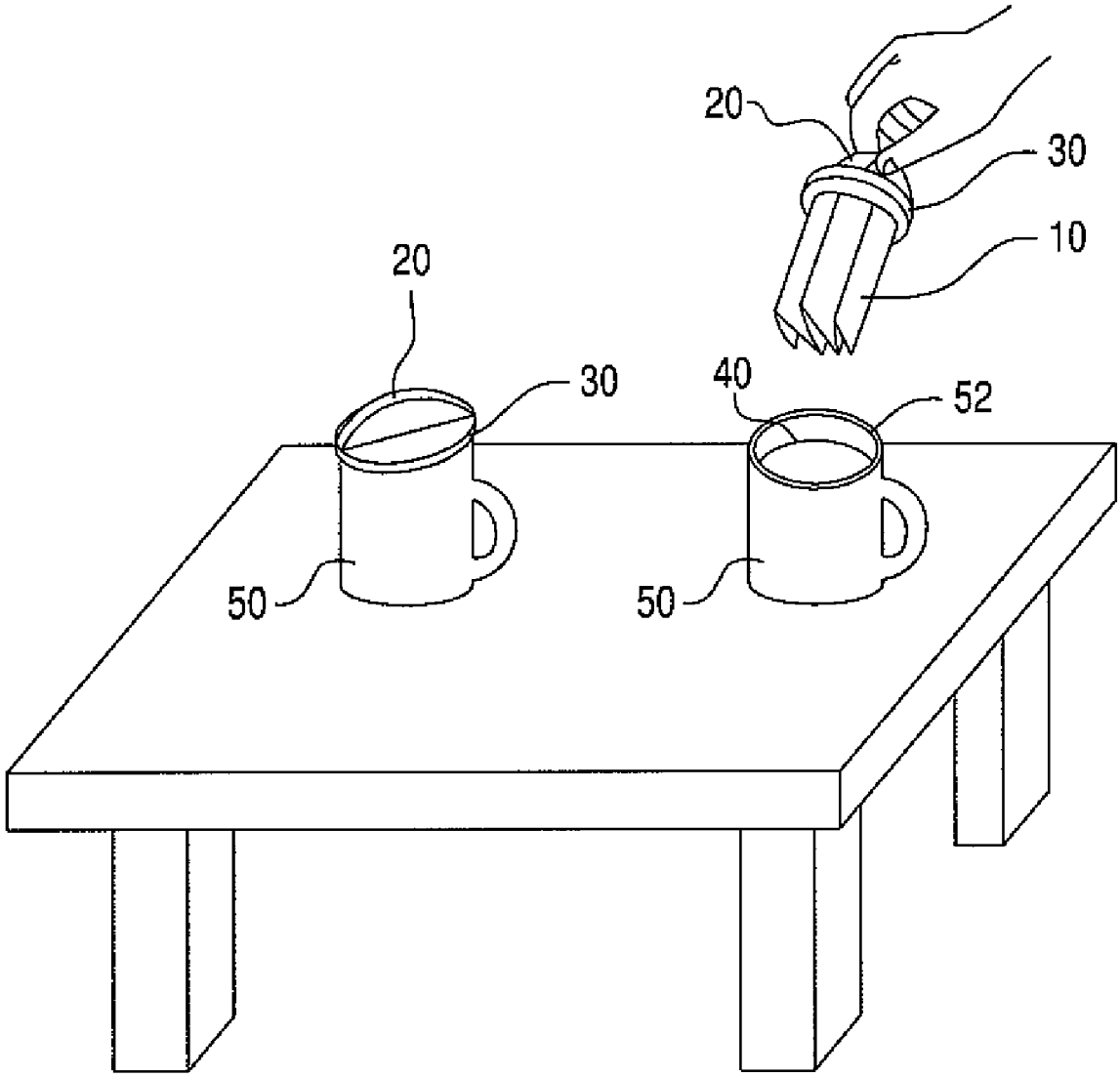
FIG. 3 is a perspective side view of more than one heat absorbing device being used.

As best shown in FIGS. 1 to 3, the heat absorbing device includes a support rim 30, a heat absorbing element 10, and a handle 20. The heat absorbing element 10 is inserted into a beverage 40 for cooling while the support rim 30 supports the device on a brim 52 or top edge of a container 50. The support rim 30 has an outer dimension d2 that is larger than an outer dimension d1 of the heat absorbing element 10 so that the support rim 30 engages the container 50 while the heat absorbing element 10 fits easily inside the inner space of the container 50. The support rim 30 may be circular, square, or any other shape that would allow the heat absorbing device to be supported on the container 50. The support rim 30 may be approximately 4 inches across, that is, d2 may be approximately 4 inches. The container 50 may be a coffee mug, cup, glass, or bowl, among other things.

The heat absorbing element 10 includes a plurality of cooling fins extending away from the support rim 30 for insertion into the beverage 40. The heat absorbing element 10 may be a sheet of thermally conductive material folded into several ridged portions 12 and planar portions 14 and 16 extending between neighboring ridged portions 12. The planar portions include outer planar portions 14 and inner planar portions 16. As best shown in FIG. 2, the inner planar portions 16 are wider than the outer planar portions 14 so that the cross-sectional shape of the heat absorbing element 10 conforms to the inner space of the container 50, which has a circular cross section.

The sheet of thermally conductive material may be rectangular. The sheet may alternatively be formed into to other shapes. The thermally conductive material may be metal, such as stainless steel, aluminum, coated metal, or metal composites. The thermally conductive material may be made thin, e.g., 1 to 2 mm, so as to displace a minimum amount of the beverage 40 in the container 50.

The folded shape of the heat absorbing element 10 maximizes the surface area that comes in contact with the beverage 40, thereby allowing for more heat to be transferred and ultimately cooling the beverage 40 faster. Additionally, because the material used to make the heat absorbing element 10 is thin, the displacement of the beverage 40 is minimized. As a result, the beverage 40 is efficiently cooled without spilling from the container 50. Thus, even when the beverage 40 is extremely hot, such as freshly brewed coffee or tea, the heat can be dissipated through the heat absorbing element 10. Although not necessary, the heat absorbing element 10 is preferably immersed in the beverage 40 for approximately one minute for very hot beverages. Of course, one of ordinary skill in the art will recognize that the amount of time it takes to cool a hot beverage using the heat absorbing element 10 will depend on various factors, for example, the material and surface area of the heat absorbing element 10, the temperature and volume of the hot beverage, etc. Thus, the beverage 40 may be cooled by the heat absorbing element 10 in less than or more than one minute.

The shape of the heat absorbing element 10 as a folded sheet of thermally conductive material makes this component easy to clean, thus preventing bacteria or other microorganisms from building up on the device. Indeed, it is easy for a sponge or brush to be disposed between the planar portions 14 and 16 of the heat absorbing element 10 for cleaning.

As best shown in FIG. 2, the handle 20 includes a protrusion 22 extending from an upper planar surface 32 of the support rim 30. Although the shape of the protrusion 22 is shown as being semi-circular, it should be understood that the protrusion 22 may have a variety of different shapes. At least one of the handle 20 and the support rim 30 are preferably formed of thermally non-conductive material so that heat from the beverage 40 is not transferred through the handle 20 and support rim 30 to burn the user's hand.

Figure 4:
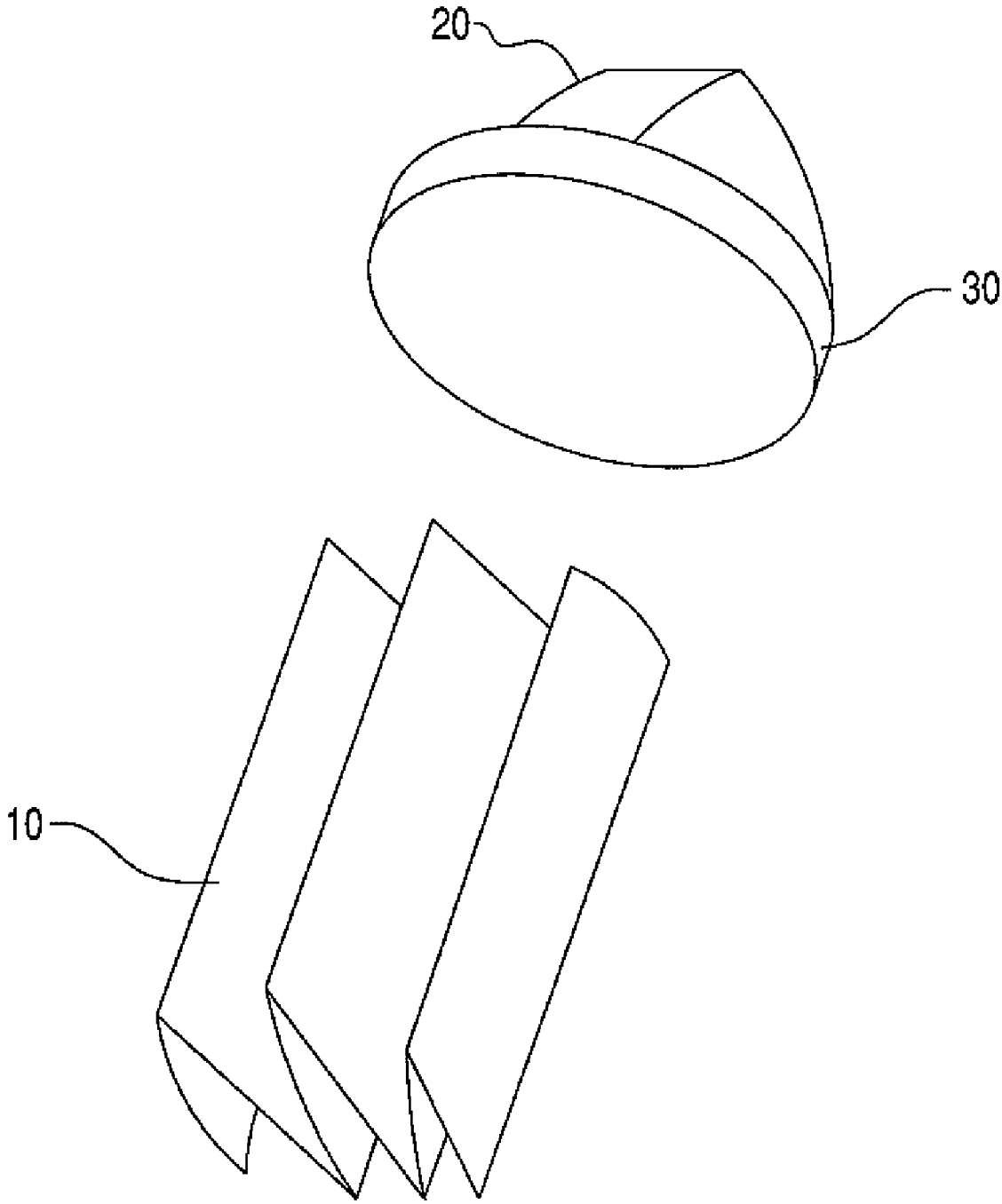
FIG. 4 is an exploded perspective view of the construction of the heat absorbing device according to an embodiment of the present invention.

As best shown in FIG. 4, the support rim 30 and the handle 20 may be formed integrally with one another. In this case, the support rim 30 and the handle 20 are preferably cast together as one piece of plastic. The heat absorbing element 10, which may be made from a bent metal sheet, is preferably fitted into the plastic piece soon after the plastic is cast or molded, i.e., when the plastic is still soft prior to drying/hardening. Thus, the manufacturing process of the present embodiment includes: 1) cutting and forming the thermally conductive heat absorbing element 10, 2) preparing the "hat" or rim 30 and handle 20 assembly using a plastic injection mold having the shape of the rim 30 and handle 20 assembly, and 3) assembling the rim 30 and handle assembly 20 with the heat absorbing element 10.

Figure 5:
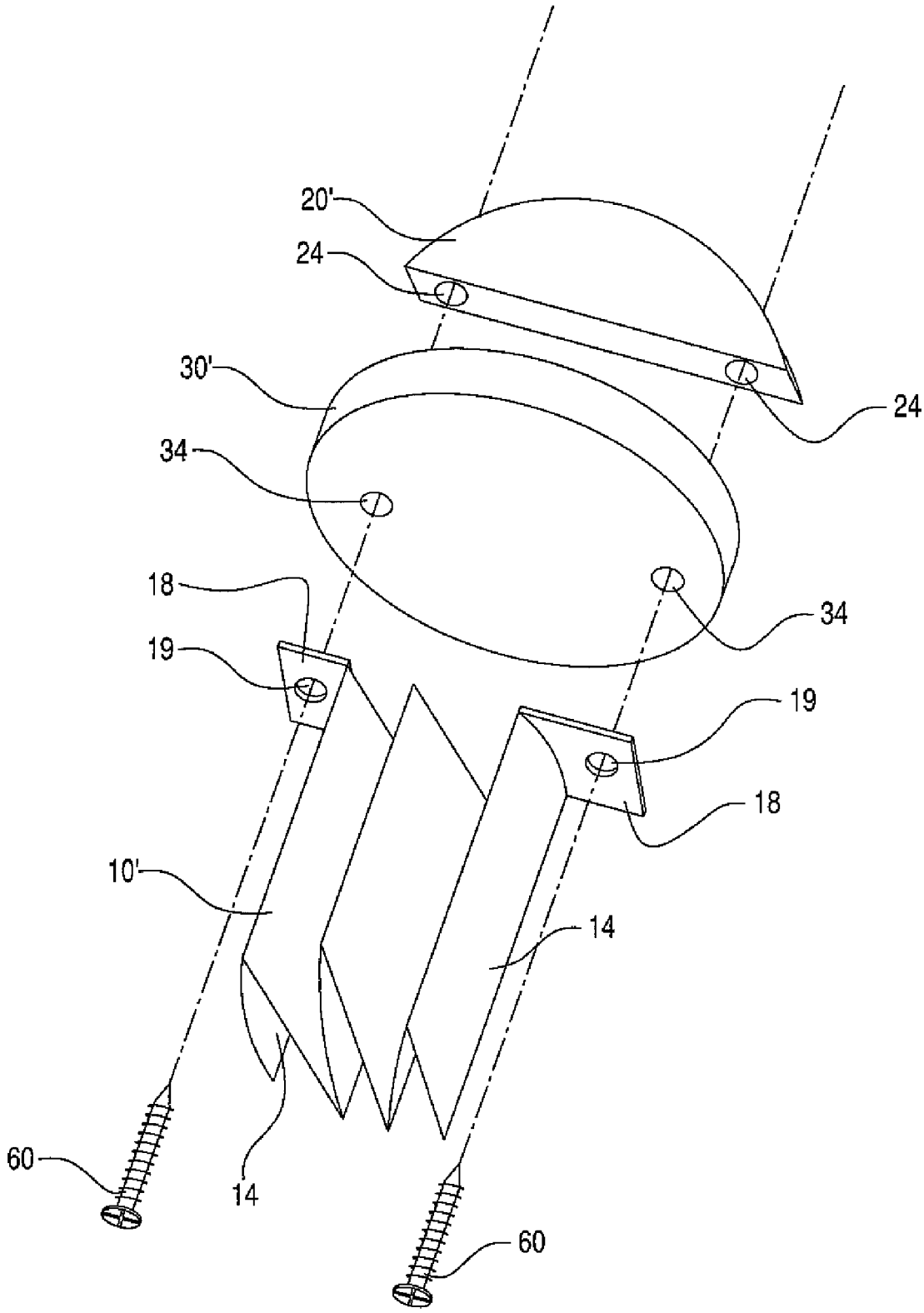
FIG. 5 is an exploded perspective view of the construction of the heat absorbing device according to another embodiment of the present invention.

Alternatively, the heat absorbing element 10 may have shoulder flanges 18 (as shown in FIG. 5) that may be welded, glued, fastened, or screwed to the bottom of the support rim 20 instead of fitting the heat absorbing element 10 into the plastic directly. In this case, the support rim 30 and/or the handle 20 may be made of other materials that do not require casting.

As best shown in FIG. 5, a heat absorbing device may include a handle 20', a support rim 30', and a heat absorbing element 10' all formed separately prior to assembly. In this case, the support rim 30' and the handle 20' may each be formed separately of wood, plastic, or any other material. Preferably, at least one of the handle 20 and support rim 30 are made of a thermally non-conductive material so that the user does not burn his or her hand. The handle 20' and the support rim 30' include fastening holes 24 and 34' respectively, for fastening these components together with the heat absorbing element 10'. To this end, the heat absorbing element 10' includes shoulder flanges 18 extending from the outer planar portions 14 thereof. The shoulder flanges 18 each include fastening holes 19 corresponding to the fastening holes 34 and 24 of the support rim 30' and the handle 20', respectively. Screws 60 attach the heat absorbing element 10' to the support rim 30' and the handle 20' via the fastening holes 19, 34, and 24.

Figure 6A:
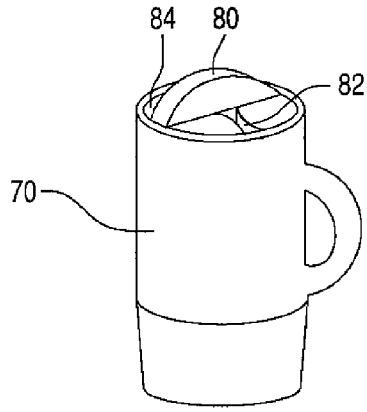
FIGS. 6A and 6B are perspective views of a container assembly according to another embodiment of the present invention.
Figure 6B:
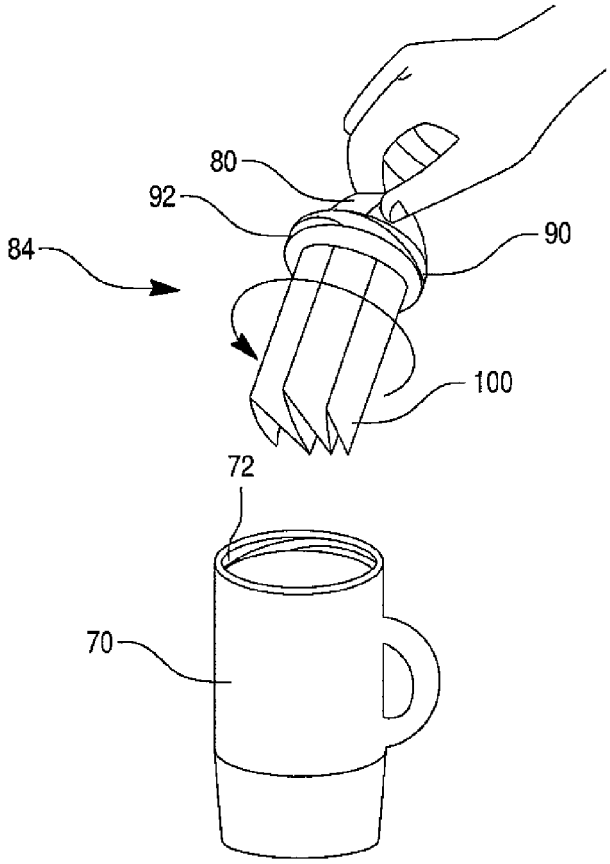

As best shown in FIGS. 6A and 6B, a beverage container assembly according to an embodiment of the present invention may include a container 70 with a first threading 72 arranged inside a brim of the container 70. A container top 84 includes a heat absorbing element 100 (similar to heat absorbing element 10), a support rim 90 having a second threading 92 arranged around a perimeter thereof, and a handle 80 disposed on the support rim 90. The container top 84 is removably coupled to the container 70 by twisting to engage the first threading 72 of the container 70 with the second threading 92 of the container top 84. Accordingly, the beverage container assembly shown in the present embodiment can be used as a travel mug in which the container top 84 is secured to the container 70. The container top 84 may further include an outlet 82 via which the beverage can be dispensed without disengaging the container top 84 from the container 70. Additionally, the beverage container assembly shown in FIGS. 6A and 6B may be specially adapted to fit in the cup holder(s) of a particular vehicle or a particular class of vehicles so that the beverage container assembly can be easily used while traveling.

Although the first and second threading 72 and 92 are shown and described as removably attaching the container top 84 to the container 70, it should be understood that other attachment mechanisms may be used in lieu of threading. For example, snap fit container tops, among other things, may be used.

Figure 7A:
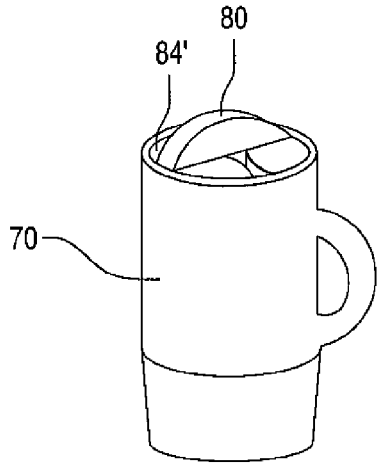
FIGS. 7A and 7B are perspective views of a container assembly according to yet another embodiment of the present invention.
Figure 7B:
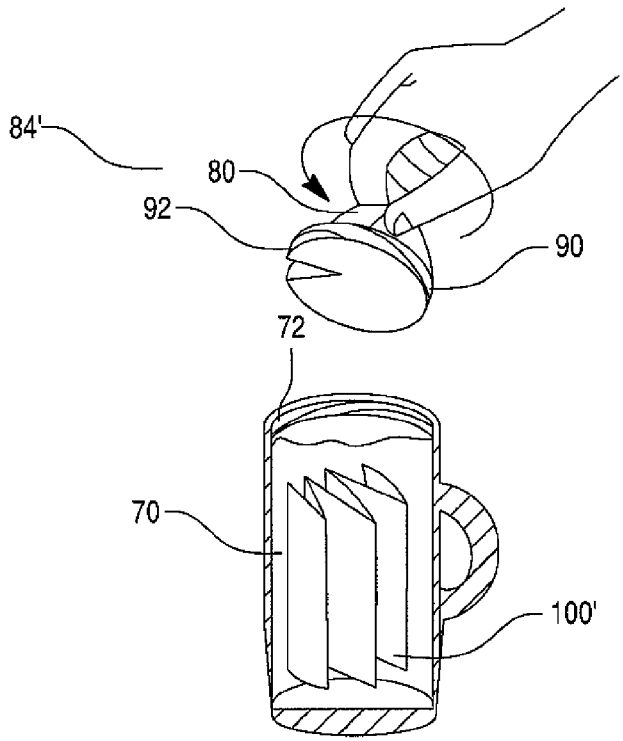

As best shown in FIGS. 7A and 7B, in another embodiment of the invention, a heat absorbing element 100' is separately disposed in the container 70 without attachment to a container top 84' or support rim 90'. In this case, the heat absorbing element 100' is either permanently embedded in the container 70 or removably positioned in the container 70.

Figure 8A:
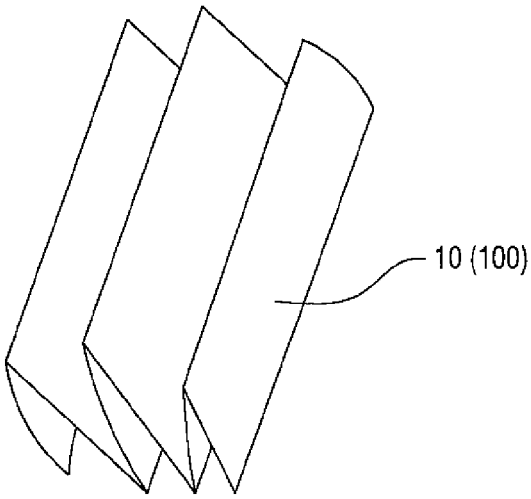
FIGS. 8A to 8D illustrate heat absorbing elements according to various embodiments of the present invention.
Figure 8B:
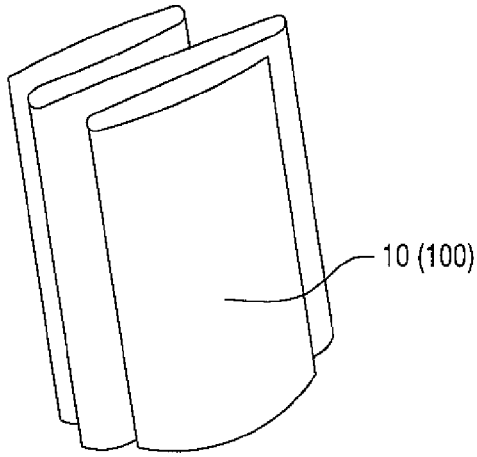

FIGS. 8A to 8D show various embodiments of the heat absorbing element 10. FIGS. 8A and 8B show the heat absorbing element 10 (100) shown in FIGS. 1 to 6B.

Figure 8C:
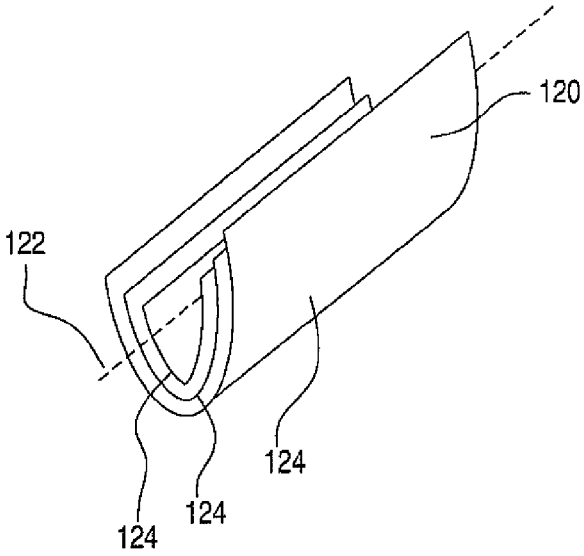

FIG. 8C shows a heat absorbing element 120 having a plurality of semi-cylindrical sheets 124 concentrically arranged about a center axis 122. The semi-cylindrical sheets 124 may be attached at one end to a support rim (not shown) and handle (not shown) via shoulder flanges (not shown) or by insertion into the support rim and handle prior to hardening, as described above.

Figure 8D:
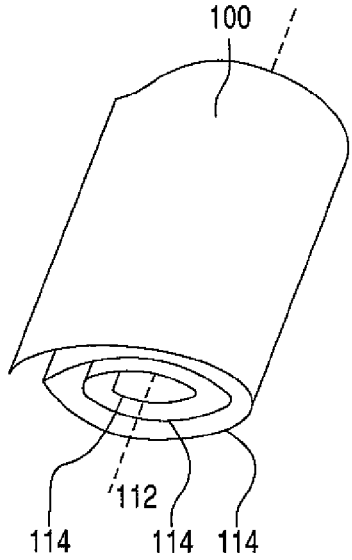

FIG. 8D shows a heat absorbing element 110 having a cylindrical spiral shape. The heat absorbing element 110 is made from a single sheet having a plurality of layers 114 wound concentrically around a center axis 112. The heat absorbing element 110 may be attached at one end to a support rim (not shown) and handle (not shown) via shoulder flanges (not shown) or by insertion into the support rim and handle prior to hardening, as described above.

Although only a few different shapes of the heat absorbing elements have been shown, it should be understood that a variety of different shapes can be used. For example, parallel rectangular sheets, which are spaced apart at equal intervals, may alternatively be used as the heat absorbing element. Other shapes may also be used.

The heat absorbing device of the embodiments of the present invention cools a hot beverage through the immersion of a heat conducting element with a large surface area into a beverage mug, cup, drinking glass, travel-style portable beverage container, or bowl. Because the heat absorbing element of the device has a low volume compared to surface area ratio due to its small thickness, minimal liquid is displaced when the device is used.

The support rim and handle can be made in a variety of shapes, designs, and materials that are aesthetically pleasing to the consumer of the hot beverage. For example, the support rim and handle can be made of hard plastic with a round or square shape. Other shapes and materials may also be used. The handle can be formed of a variety of materials, for example, stainless steel, wood, plastic, marble, or a combination thereof. The shape of the handle and support rim, which may also be referred to as a "hat" of the beverage, may be custom designed to fit the theme of a restaurant or hotel or may be ornamental designs.

Although the foregoing embodiments describe a heat absorbing device for cooling a beverage, it should be understood that the heat absorbing device can be used to cool any hot liquid. In this case, the size of the device can be adapted to fit the size of the container carrying the liquid.

Although embodiments of the present invention have been shown and described, it will be appreciated by those skilled in the art that changes may be made in these embodiments without departing from the principles and spirit of the invention, the scope of which is defined in the appended claims and their equivalents.

We claim:

1. A heat absorbing device usable to cool hot beverages, the device comprising:

a support rim for supporting the device on a brim of a container;

a heat absorbing element extending away from said support rim in a first direction, said heat absorbing element comprising a thermally conductive material for absorbing heat from a liquid in the container, said heat absorbing element being a foldable sheet of said thermally conductive material having opposite surfaces adapted to contact said beverages; and a handle extending away from said support rim in a second direction opposite to the first direction, said handle usable for positioning said heat absorbing element in the container and for removing said heat absorbing element from the container.

2. The heat absorbing device of claim 1, wherein said heat absorbing element comprises a plurality of cooling fins extending from said support rim, said foldable sheet terminating at an edge facing away from said support rim.

3. The heat absorbing device of claim 1, wherein said heat absorbing element comprises a single sheet of metal folded into a series of ridged portions and planar portions extending between neighboring ridged portions.

4. The heat absorbing device of claim 3, wherein said series of ridged portions and planar portions comprise outer planar portions and at least one inner planar portion disposed between said outer planar portions, said outer planar portions each having an area that is less than an area of said at least one inner planar portion.

5. The heat absorbing device of claim 1, wherein said heat absorbing element comprises a plurality of semi-cylindrical metal sheets, said semi- cylindrical metal sheets being arranged concentrically with respect to one another.

6. The heat absorbing device of claim 1, wherein said support rim has a first width dimension arranged in a third direction extending perpendicularly to the first and second direction and said heat absorbing element has a second width dimension in the third direction, said first width dimension being greater than the second width dimension.

7. The heat absorbing device of claim 3, wherein said heat absorbing element is comprised of at least one sheet of metal approximately between 1 and 2 mm thick.

8. The heat absorbing device of claim 1, wherein said handle is formed integrally with said support rim, said handle and support rim being formed of a thermally insulative material.

9. The heat absorbing device of claim 8, wherein said thermally insulative material comprises one of wood and plastic.

10. The heat absorbing device of claim 1, wherein:

said support rim comprises a lower planar surface opposite to where said handle is located; and said heat absorbing element comprises at least one shoulder flange extending perpendicularly to the first and second directions, said at least one shoulder flange being fastened to said lower planar surface of said support rim.

11. The heat absorbing device of claim 10, wherein said at least one shoulder flange of said heat absorbing element and said lower planar surface of said support rim each include corresponding fastening holes, and said heat absorbing device further comprises:

at least one screw extending through the corresponding fastening holes for fixing said heat absorbing element to said lower planar surface of the support rim.

12. A heat absorbing device usable to cool hot beverages, the device comprising:

a support rim for supporting the device on a brim of a container;

a heat absorbing element extending away from said support rim in a first direction, said heat absorbing element comprising a thermally conductive material for absorbing heat from a liquid in the container; and a handle extending away from said support rim in a second direction opposite to the first direction, said handle usable for positioning said heat absorbing element in the container and for removing said heat absorbing, element from the container, wherein said heat absorbing element comprises a sheet of metal wound into a spiral having a central axis, said central axis of said spiral for positioning along a longitudinal direction of the container.

13. A beverage container assembly, the container assembly comprising:

a container including a bottom wall and a side wall extending upwardly from said bottom wall, said bottom and side walls defining an inner space of said container, and a top edge of said side wall forming a brim of said container;

a beverage disposed in said inner space of said container; and a heat absorbing element disposed in said inner space of said container for absorbing heat from said beverage contained therein, said heat absorbing element comprising at least one elongated fin extending along a longitudinal center axis of said inner space.

14. The beverage container assembly of claim 13, wherein said heat absorbing element is part of a heat absorbing device comprising:

a support rim resting on said brim of said container;

said heat absorbing element attached to said support rim and extending from said support rim downwardly into said inner space of said container; and a handle extending from said support rim upwardly away from said heat absorbing element, said handle usable for positioning said heat absorbing element in said container and for removing said heat absorbing element from said container.

15. The beverage container assembly of claim 14, wherein said heat absorbing element is part of a heat absorbing device comprising:

a support rim fitted to said brim of said container for removably attaching said support rim to said brim;

said heat absorbing element extending from said support rim downwardly into said inner space of said container; and a handle extending from said support rim upwardly away from said heat absorbing element, said handle usable for positioning said heat absorbing element in said container and for removing said heat absorbing device from said container.

16. The beverage container assembly of claim 15, further comprising:

a first threading arranged on said brim of said container;

a second threading arranged on said support rim, said support rim being removably attached to said brim of said container via said first and second threadings.

17. The beverage container assembly of claim 13, further comprising:

a container top fitted to said brim of said container, said container top being removably coupled to said brim of said container.

18. The beverage container assembly of claim 17, wherein said heat absorbing element is embedded in said container.

19. The beverage container assembly of claim 13, wherein said heat absorbing element comprises a plurality of cooling fins formed by a sheet of metal folded into a series of ridged portions and planar portions extending between neighboring ridged portions.

20. The beverage container assembly of claim 13, wherein said at least one elongated fin has one of a spiral shape, a wavy shape, a semi-cylindrical shape, and a full cylinder shape.

21. A method of cooling a hot beverage in a container using a heat absorbing device including a support rim, a heat absorbing element formed as a sheet defining a plurality of elongated fins extending away from the support rim in a first direction, and a handle extending away from the support rim in a second direction opposite to the first direction, the method comprising:

grabbing the handle of the heat absorbing device; and inserting the plurality of elongated fins of the heat absorbing device into the container such that the support rim is supported on a brim of the container and the fins extend downwardly from the support rim into the beverage, said fins having opposite surfaces and terminating at an edge facing away from said support rim, wherein said opposite surfaces are adapted to contact said hot beverage.

* * * * *